US005983869A

United States Patent [19]

Cooke et al.

[11] Patent Number: 5,983,869

[45] Date of Patent: Nov. 16, 1999

[54] FUEL SYSTEM

[75] Inventors: Michael Peter Cooke, Gillingham; Paul Francis Garland, Rochester; Christopher Stringfellow, Sittingbourne; Christopher Matthew Moore, Maidstone; Paul Raymond Smith, Chatham, all of United Kingdom

[73] Assignee: Lucas Industries plc, United Kingdom

[21] Appl. No.: 09/110,742

[22] Filed: Jul. 2, 1998

[51] Int. Cl.[6] ..... F02M 37/00

[52] U.S. Cl. ..... 123/514

[58] Field of Search ..... 123/514, 456, 123/457

[56] References Cited

U.S. PATENT DOCUMENTS 4,483,285 11/1984 Donnerstag et al. ..... 123/514
5,133,324 7/1992 Michiaki ..... 123/514
5,285,759 2/1994 Terada et al. ..... 123/514
5,289,810 3/1994 Bauer et al. ..... 123/514
5,339,785 8/1994 Wilksch ..... 123/514
5,396,872 3/1995 Ruger et al. ..... 123/514

*Primary Examiner*—Thomas N. Moulis
*Attorney, Agent, or Firm*—Andrus, Sceales, Starke & Sawall

[57] ABSTRACT

A fuel system is described which comprises a high pressure fuel pump arranged to supply fuel under pressure to a plurality of injectors. A backleak connection line is arranged to return fuel from the injectors to a fuel reservoir. A venturi pump is connected to the backleak connection line and is arranged to draw fuel from the line to reduce the fuel pressure therein.

7 Claims, 5 Drawing Sheets

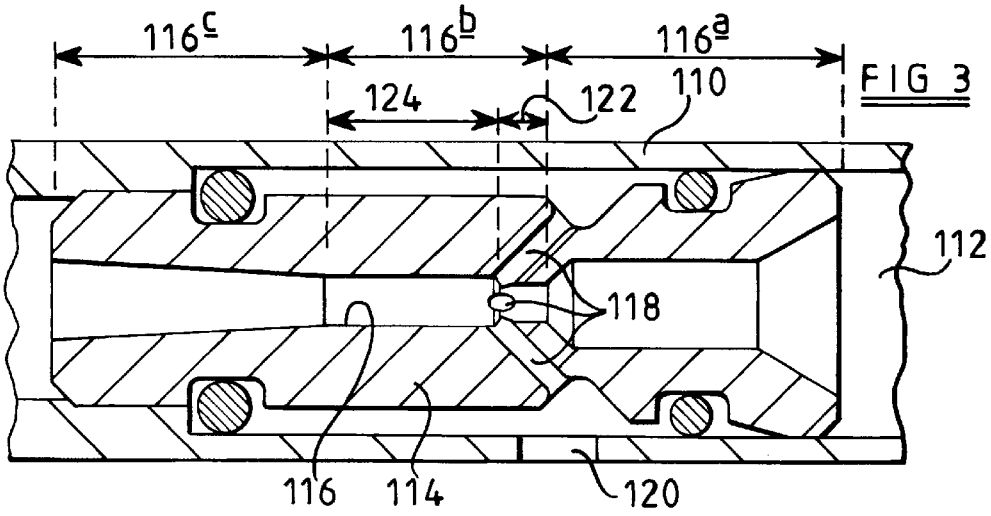
FIG 3
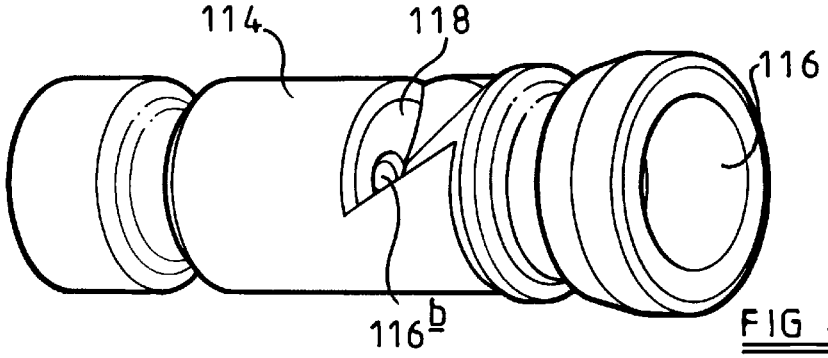
FIG 4
FIG 5
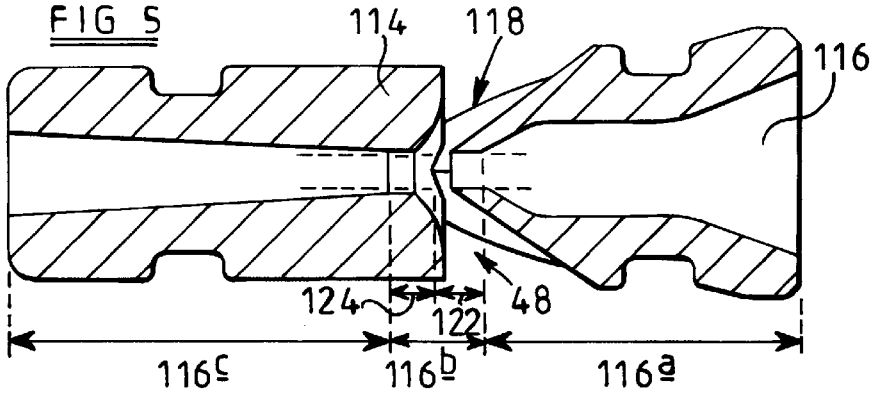

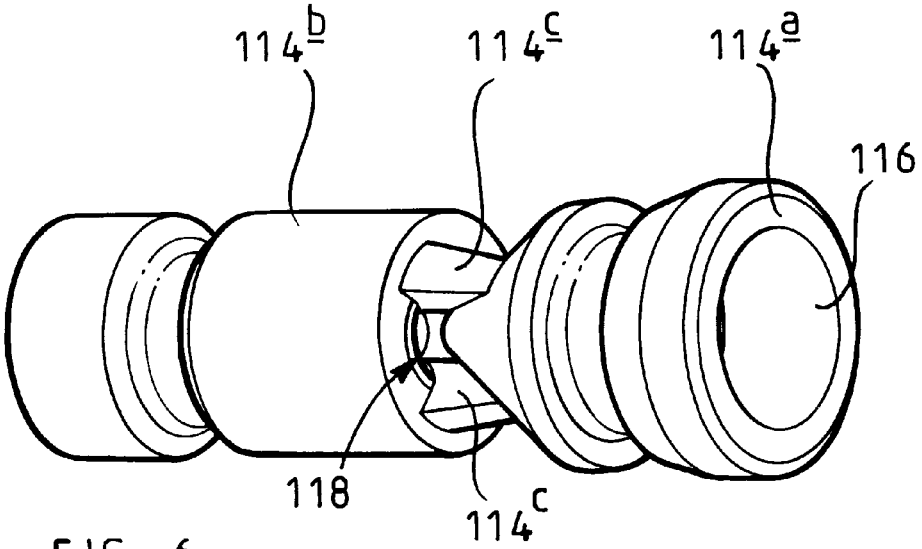
FIG 6
FIG 7
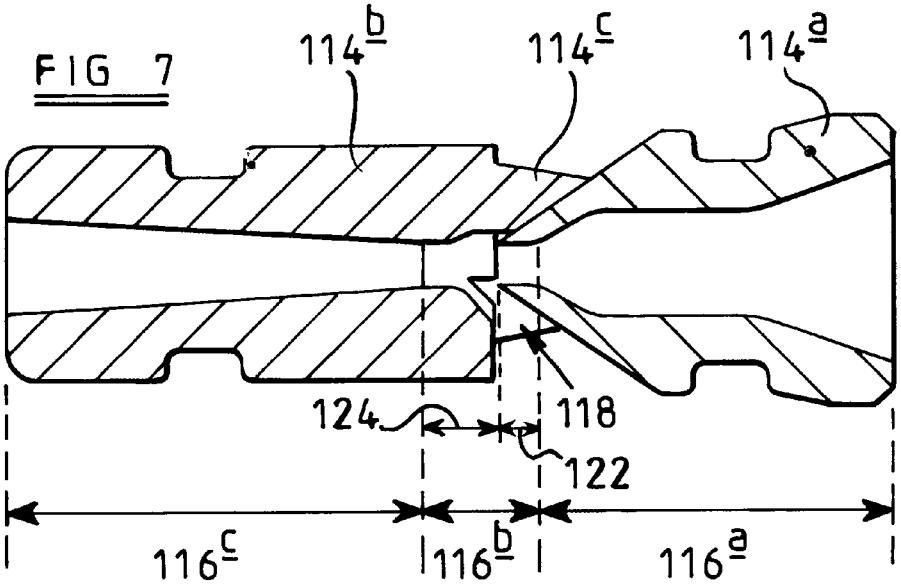

FUEL SYSTEM

This invention relates to a fuel system for use in supplying fuel to the cylinders of a compression ignition internal combustion engine. In particular, this invention relates to a fuel system of the type comprising a high pressure fuel pump arranged to supply fuel to a plurality of injectors, and a backleak connection line whereby fuel from the injectors can be returned to a fuel reservoir. The fuel system may, for example, be of the common rail type.

In such a fuel system, it has been found that by applying a vacuum to the backleak connection line in order to reduce the fuel pressure therein, consistency between injections can be improved as the reduced pressure causes fuel and air within the backleak connection line to form a foam which is capable of absorbing pressure spikes which occur during the operation of each injector.

It is an object of the invention to provide a fuel system of the type described hereinbefore which is of simple form.

According to the present invention there is provided a fuel system of the type described hereinbefore, further comprising a venturi pump connected to the backleak connection line and arranged to draw fuel from the backleak connection line to reduce the fuel pressure therein.

The venturi pump is conveniently located in a line connecting the backleak connection from the cam box of the high pressure fuel pump to the fuel reservoir.

Alternatively, where the fuel system is of the common rail type, the venturi pump may be located in a return fuel line connecting the common rail to the fuel reservoir. Alternatively, the venturi pump may be connected to the inlet of the high pressure pump.

The venturi pump is conveniently of the type comprising a throat member defining a flow passage including a throat region, and at least one feed port communicating with the throat region, wherein the part of the throat region immediately downstream of the feed port is of greater cross-sectional area than the part of the throat region immediately upstream of the feed port.

As the part of the throat region immediately downstream of the feed port is of enlarged cross-sectional area, the flow of fluid through the feed port does not result in a significant increase in the velocity of fluid flowing past the end of the feed port, thus a relatively large magnitude vacuum can still be drawn.

The throat member conveniently takes the form of an insert intended to be received within a flow passage provided in a housing.

The invention will further be described, by way of example, with reference to the accompanying drawings, in which:

FIG. 3 is a view similar to FIG. 2 illustrating an alternative venturi pump suitable for use in the fuel system of FIG. 1;

FIGS. 4 and 5 are a perspective view and a sectional view, respectively, of a modification to the embodiment of FIG. 3; and FIGS. 6 to 9 are views similar to FIGS. 4 and 5 illustrating two alternative embodiments.

Figure 1:
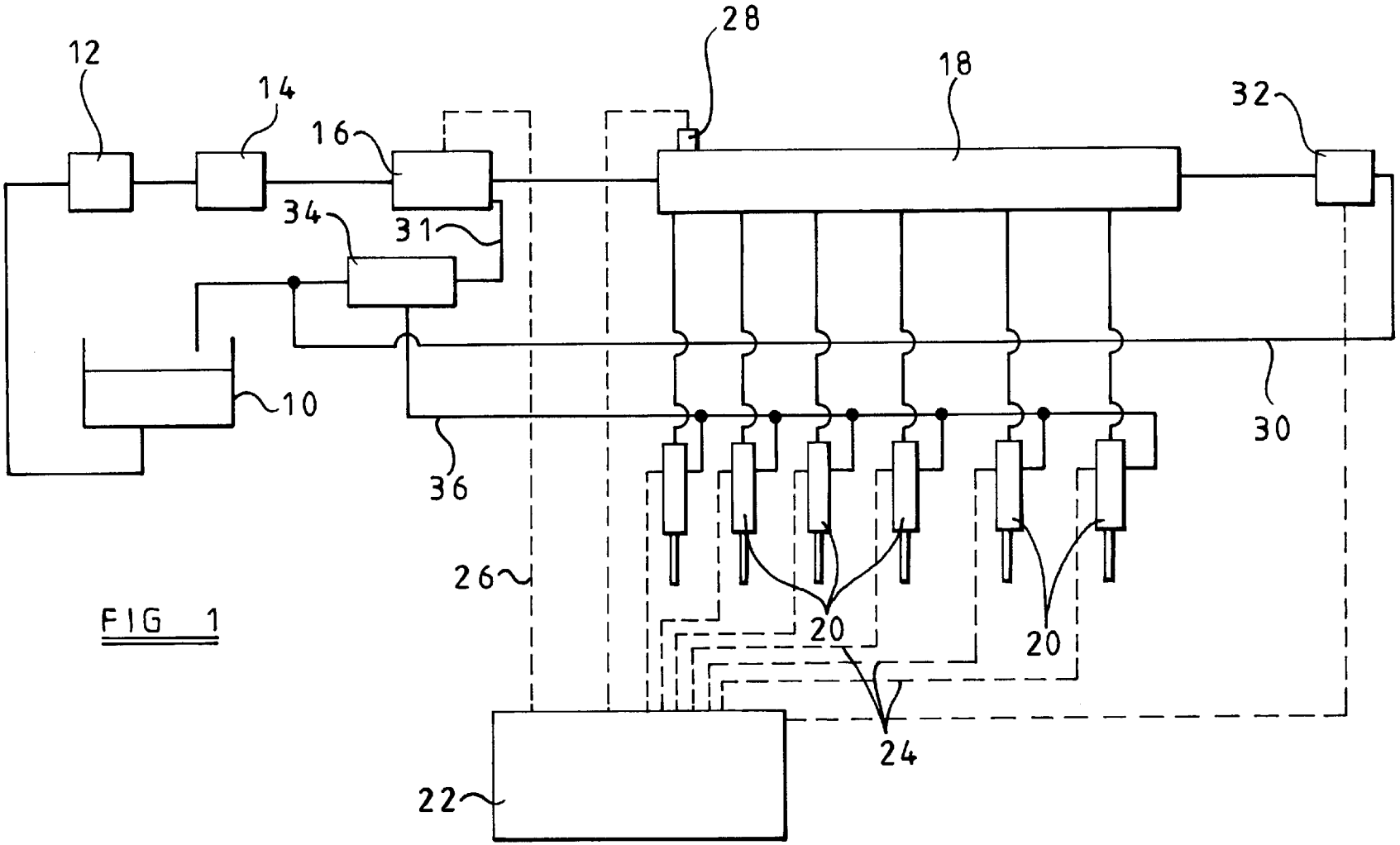
FIG. 1 is a diagrammatic view of a fuel system of an embodiment of the invention.

The fuel system illustrated in FIG. 1 comprises a fuel reservoir 10 which is connected through a filter 12 and low pressure fuel pump 14 with the inlet of a high pressure fuel pump 16. If desired, the low pressure pump may be located upstream of the filter. The high pressure fuel pump 16 is arranged to supply fuel under high pressure to a common rail 18 from which fuel is supplied under pressure to the inlets of a plurality of electromagnetically actuated injectors 20. The injectors 20 are operable under the control of an electronic controller 22 which is connected to the injectors 20 through control lines 24. The controller 22 is also connected through a control line 26 to the high pressure fuel pump 16 in order to control, for example, the rate at which fuel is being supplied to the common rail 18 by the high pressure fuel pump 16. The fuel pressure within the common rail 18 is sensed by a pressure sensor 28, the output of which is supplied to the controller 22 and is used to determine how much fuel should be supplied to the common rail 18 by the high pressure fuel pump 16.

The common rail 18 communicates through a return line 30 with the fuel reservoir 10, a pressure limiting valve 32 being located in the return line 30 in order to maintain the fuel pressure within the common rail 18 at the desired working pressure. A backleak connection from the cam box of the high pressure fuel pump 16 is connected to a line 31 to return fuel to the fuel reservoir 10. This fuel is used, within the pump, to cool and lubricate the working parts within the pump cam box. Also located within the line 31 is a venturi pump 34, the throat of which is connected to a backleak connection line 36 which is connected to the backleak connection port of each of the injectors 20.

Figure 2:
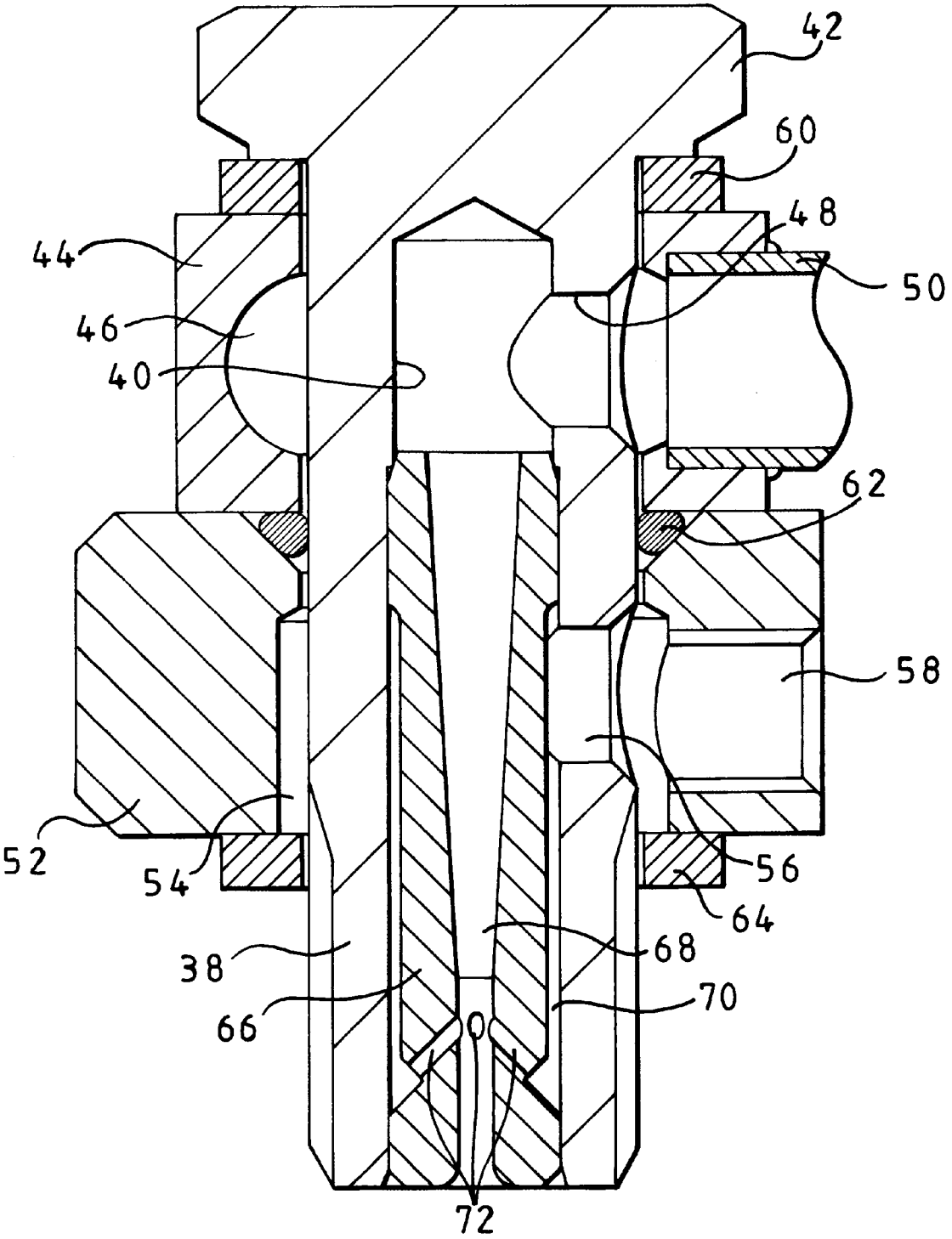
FIG. 2 is a sectional view of the venturi pump used in the fuel system of FIG. 1.

FIG. 2 illustrates a venturi pump suitable for use in the fuel system of FIG. 1. The venturi pump of FIG. 2 comprises a body 38 having a blind bore 40 provided therein. The body 38 includes a head 42 of enlarged diameter, and the end of the body 38 remote from the head 42 is screw-threaded.

An outlet connector 44 is secured to the body 38, the connector 44 being of annular form, the inner surface of the connector 44 including a groove which defines, with the body 38, an outlet chamber 46. The outlet chamber 46 communicates with the bore 40 through a radial passage 48 provided in the body 38. A drain line 50 is secured to the connector 44, communicating with the outlet chamber 46, the drain line 50 communicating with the fuel reservoir 10, in use.

A backleak line connector 52 is located adjacent the connector 44, the backleak line connector 52 including an opening through which the body 38 extends, the body 38 and connector 52 defining a backleak chamber 54 which communicates with the bore 40 through a radial passage 56. The connector 52 includes a threaded bore 58 arranged to be connected, in use, to an end of the backleak connection line 36 to permit fuel from the backleak connection line 36 to flow to the backleak chamber 54.

A return line connector (not shown) secured to the line 31 is secured, in use, to the threaded part of the body 38 to supply returned fuel to the bore 40. A sealing washer 60 is located between the connector 44 and the head 42, an O-ring 62 is located between the connector 44, the body 38 and the backleak line connector 52, and a sealing washer 64 is located between the backleak line connector 52 and return line connector. It will be appreciated that the return line connector secures the connector 44 and backleak line connector 52 in position, and applies a force of sufficient magnitude to the sealing washers 60, 64 and O-ring 62 to seal the connector 44 and backleak line connector 52 to the body 38.

A throat member 66 is located within the bore 40 and is secured in position by the return line connector. The throat member 66 includes an axially extending passage 68 which includes a throat region of uniform, relatively small diameter adjacent the return line connector and a region which tapers to a maximum diameter at the end remote from the return line connector. The outer surface of the throat member 66 defines, with the bore 40, a chamber 70 which communicates with the passage 56. Drillings 72 are provided in the throat member 66 to provide communication between the chamber 70 and the throat region of the passage 68.

In use, fuel returned from the common rail high pressure pump flows through the passage 68, exiting the venturi pump through the outlet chamber 46 to be returned through the drain line 50 to the fuel reservoir. The shape of the passage 68 is such that the diameter of the throat region is smaller than that of the line 31, thus the velocity of fuel within the throat region is higher than that within the line 31. The increased velocity results in the fuel pressure within the throat region being reduced, drawing fuel from the chamber 70 through the drillings 72, thus reducing the fuel pressure within the backleak connection line 36.

The reduced pressure within the backleak connection line 36 is advantageous in that it serves to maintain the fuel and gases within the backleak connection line 36 in the form of a foam which is capable of absorbing the pressure spikes or pulses which occur during injection which otherwise are detrimental to the operation of the other injectors connected to the backleak connection line 36.

Although the description hereinbefore is of an arrangement in which the venturi pump is located in the line 31, it could be located elsewhere in the fuel system, for example at the inlet of the high pressure fuel pump in either a common rail system or in another type of fuel system, or in the return line 30 of the common rail system.

FIG. 3 illustrates a venturi pump arrangement which comprises a housing 110 defining a fluid flow passage 112. A throat member 114 is located within the passage 112, the throat member 114 including an axially extending through passage 116. The throat member 114 is shaped such that the passage 116 includes a first tapering region 116*a* in which the diameter of the passage 116 tapers from a maximum at the upstream end of the throat member 114 to a minimum adjacent a throat region 116*b* of the passage. The diameter of the passage 116 gradually increases in a second tapering region 116*c* located downstream of the throat region 116*b*. A plurality of ports 118 communicate with the throat region 116*b*, the ports 118 communicating with an opening 120 which, in use, is connected to the backleak connection line 36 through which fuel is to be drawn.

In the arrangement of FIG. 3, the first tapering region 116*a* is constituted by an upstream frusto-conical region, a region of substantially uniform diameter, and a downstream frusto-conical region which is adjacent the upstream edge of the throat region 116*b*. The throat region 116*b* is constituted by a first, upstream end 122 of relatively small diameter, and a second, downstream end 124 which is of diameter greater than the diameter of the upstream end 122. The first and second ends 122, 124 of the throat region 116*b* together define a step. The ports 118 communicate with the through passage 116 defined by the throat member 114 at positions which straddle the step, thus part of each port 118 opens into the first, upstream end 122 of the throat region 116*b*, each port 118 further including a part which opens into the second, downstream end 124 of the throat region 116*b*.

The downstream end 124 of the throat region 116*b* opens into the second tapering region 116*c* of the through passage 116 defined by the throat member 114.

In use, where the venturi pump is used in the fuel system of FIG. 1, the opening 120 is connected to the backleak connection line 36 through which fuel is to be drawn. The flow passage 112 is connected to the line 31 such that fuel flows along the flow passage 112 and through the passage 116 defined by the throat member 114. It will be appreciated that the flow of fuel along the flow passage 112 is at relatively low velocity upstream of the throat member 114, the velocity of the fuel increasing as it flows through the first tapering region 116*a* of the throat member 114. The velocity of the fuel flowing through the first, upstream end 122 of the throat region 116*b* is significantly greater than that within the flow passage 112 upstream of the throat member 114, and as a result, the fuel pressure at the ends of the ports 118 is relatively low. As the fuel pressure at the ends of the ports 118 is relatively low, a vacuum is drawn in the backleak connection line 36, and fuel is drawn from the line 36 through the opening 120 and the ports 118, the fuel joining the flow of fuel through the passage 116 and the flow passage 112.

The second, downstream end 124 of the throat region 116*b* is of sufficiently large diameter relative to that of the first, upstream end 122 of the throat region 116*b* that the increase in quantity of fuel flowing through this part of the throat region 116*b* relative to the first, upstream end 122 thereof does not significantly increase the velocity of the fuel flowing through the throat region 116*b*. As the velocity of fuel flowing through the throat region 116*b* is not significantly changed by the addition of fuel thereto from the ports 118, a significant reduction in fluid pressure can still be achieved at the opening 120, and hence a relatively large magnitude vacuum can be drawn in the backleak connection line 36, even when fuel flows through the ports 118 at a significant rate.

Although the arrangement illustrated in FIG. 3 contains four ports 118, it will be appreciated that the arrangement may be modified to incorporate a different number of ports 118, if desired. For example, FIGS. 4 and 5 illustrate an arrangement containing two ports 118, each port 118 being defined by a recess formed in the outer periphery of the throat member, the recesses being shaped such that the parts thereof defining the ports 118 open into the throat region 116*b* of the throat member 114 around the complete circumference of the part of the throat region 116*b* at the intersection of the first end 122 and the second end 124 thereof.

The throat member 114 illustrated in FIGS. 4 and 5 is designed to permit manufacture by injection moulding, and can be moulded as a single component using a reasonably small number of slides in the mould. The injection moulding process may be simplified further by manufacturing the throat member 114 in two separate pieces for example as illustrated in FIGS. 6 and 7 or in FIGS. 8 and 9.

In the arrangement illustrated in FIGS. 6 and 7, the throat member 114 is defined by a first, upstream component 114*a* which defines the first tapering region 116*a* and first, upstream end 122 of the throat region 116*b*, and a second, downstream component 114*b* which defines the second end 124 of the throat region 116*b* and the second tapering region 116*c*. As shown most clearly in FIG. 6, the second component 114*b* of the throat member 114 includes three projections 114*c* which together serve to locate a frusto-conical end surface of the first component 114*a* such that the combination of the first and second components 114*a*, 114*b* and the projections 114*c* together define the ports 118 through which fuel is able to flow. As the ports 118 are located at the connection of the first and second components 114*a*, 114*b*, it will be appreciated that the ports 118 are aligned with the intersection between the first and second ends 122, 124 of the throat region 116*b*.

In the assembly illustrated in FIGS. 6 and 7, the first and second components 114*a*, 114*b* of the throat member 114 are conveniently secured to one another by axial clamping, or by friction welding, achieved by rotating the first and second components 114*a*, 114*b* relative to one another, or by using an appropriate adhesive.

Figure 8:
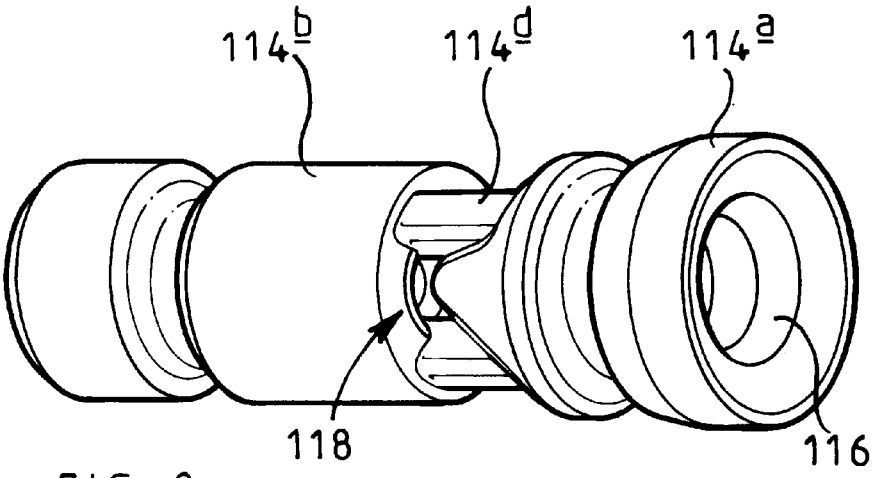
Figure 9:
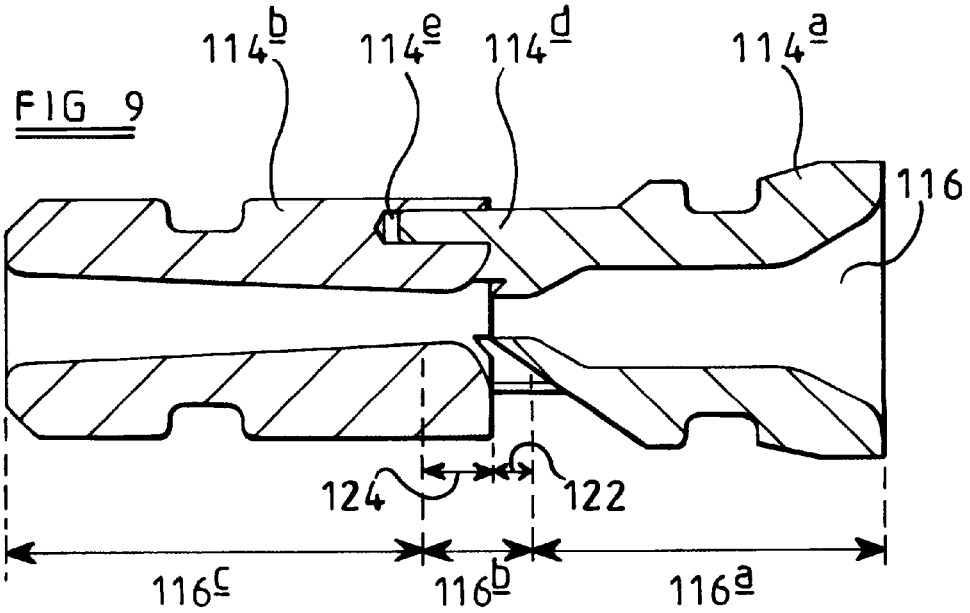

FIGS. 8 and 9 illustrate an alternative arrangement in which the projections 114*c* are omitted, and instead projections 114*d* are provided on the first component 114*a* of the throat member 114. The projections 114*d* are arranged to be received within corresponding recesses or bores 114*e* formed in the second component 114*b* of the throat member 114. The projections 114*d* serve to correctly locate the first and second components 114*a*, 114*b* of the throat member 114 with respect to one another, and to secure the components 114*a*, 114*b* to one another. The components 114*a*, 114*b* may simply be secured together by being a press fit, or alternatively may be welded by ultrasonic welding in which the first and second components 114*a*, 114*b* are vibrated axially with respect to one another.

Although in the description hereinbefore the venturi pump is driven by fuel flowing through the line 31, it will be appreciated that it may be driven by other sources of fuel. For example, fuel flowing from the outlet of a transfer pump back towards a fuel reservoir, to the inlet of the transfer pump or to the cam box of a high pressure fuel pump. Alternatively, where a fuel system incorporates a lift pump, the fuel used to drive the venturi pump may be derived from the output of the lift pump.

We claim:

1. A fuel system comprising a high pressure fuel pump arranged to supply fuel under pressure to a plurality of fuel injectors, a backleak connection line whereby fuel from the injectors can be returned to a fuel reservoir, and a venturi pump connected to the backleak connection line and arranged to draw fuel from the backleak connection line to reduce the fuel pressure therein.

2. A fuel system as claimed in claim 1, wherein the venturi pump is located in, and driven by the flow of fuel along, a line connecting a backleak connection of a cam box of the high pressure fuel pump and the fuel reservoir.

3. A fuel system as claimed in claim 1, wherein the venturi pump is located in and driven by the flow of fuel along a line connected to an outlet of a transfer pump.

4. A fuel system as claimed in claim 1, wherein the venturi pump is located in and driven by the flow of fuel along a line connected to an outlet of a lift pump.

5. A fuel system as claimed in claim 1, further comprising a common rail from which fuel is supplied to the injectors, wherein the venturi pump is located in and driven by a flow of fuel along a line connecting the common rail to the fuel reservoir.

6. A fuel system as claimed in claim 1, wherein the venturi pump comprises a throat member defining a flow path and including a throat region of dimensions causing fuel to flow at an increased velocity through the throat region relative to a part of the flow path upstream of the throat region, at least one feed port communicating with the throat region.

7. A fuel system as claimed in claim 6, wherein the throat region includes a downstream region of cross-sectional area greater than that of an upstream region, the feed port being located at the intersection of the upstream and downstream regions.

* * * * *

UNITED STATES PATENT AND TRADEMARK OFFICE

CERTIFICATE OF CORRECTION

PATENT NO: 5,983,869

DATED: November 16, 1999

INVENTOR(S): Michael P. Cooke et al

It is certified that error appears in the above-identified patent and that said Letters Patent are hereby corrected as shown below:

[30] Foreign Application Priority Data

| | | | |
|---|---|---|---|
| July 26, 1997 | [GB] | United Kingdom | 9715738.2 |
| May 23, 1998 | [GB] | United Kingdom | 9811063.8 |

Signed and Sealed this

First Day of May, 2001

*Attest:*

Nicholas P. Godici

NICHOLAS P. GODICI

*Attesting Officer*

*Acting Director of the United States Patent and Trademark Office*